US007493987B2

(12) United States Patent
Puszkiewicz et al.

(10) Patent No.: US 7,493,987 B2
(45) Date of Patent: Feb. 24, 2009

(54) PLATFORM LOAD SENSING FOR VERTICAL LIFTS

(75) Inventors: Ignacy Puszkiewicz, Smithsburg, MD (US); Mohamed Yahiaoui, Hazard, KY (US); Louis A. Bafile, Mercersburg, PA (US); Eli Neuman, Caesarea (IL)

(73) Assignee: JLG Industries, Inc., McConnellsburg, PA (US)

( * ) Notice: Subject to any disclaimer, the term of this patent is extended or adjusted under 35 U.S.C. 154(b) by 1050 days.

(21) Appl. No.: 10/236,911

(22) Filed: Sep. 9, 2002

(65) Prior Publication Data

US 2004/0045768 A1 Mar. 11, 2004

(51) Int. Cl.
*B66F 11/00* (2006.01)

(52) U.S. Cl. ..... 182/69.5

(58) Field of Classification Search ..... 182/63.1, 182/69.4–69.6

See application file for complete search history.

(56) References Cited

U.S. PATENT DOCUMENTS

| | | | | |
|---|---|---|---|---|
| 3,228,659 | A | 1/1966 | Sturm | |
| 3,695,096 | A | 10/1972 | Kutsay | |
| 3,920,096 | A | 11/1975 | Fisher | |
| 4,252,213 | A | 2/1981 | Ekman | |
| 4,326,601 | A | 4/1982 | Grove et al. | |
| 4,833,615 | A | 5/1989 | Bitner et al. | |
| 4,930,598 | A * | 6/1990 | Murrill et al. | 182/69.5 |
| 5,178,226 | A * | 1/1993 | Bowman et al. | 177/139 |
| 5,992,562 | A * | 11/1999 | Boeckman et al. | 182/63.1 |
| 6,234,508 | B1 * | 5/2001 | Tuttle et al. | 280/406.1 |
| 2003/0060923 | A1 * | 3/2003 | Scotese | 700/217 |

FOREIGN PATENT DOCUMENTS

| | | |
|---|---|---|
| DE | 30 45 196 | 7/1982 |
| DE | 37 11 239 | 10/1987 |
| EP | 1 186 568 | 3/2002 |
| FR | 2 732 001 | 9/1996 |
| FR | 2 733 493 | 10/1996 |
| GB | 2 031 594 | 4/1980 |
| GB | 2 062 258 | 5/1981 |

* cited by examiner

*Primary Examiner*—Alvin C Chin-Shue
(74) *Attorney, Agent, or Firm*—Nixon & Vanderhye P.C.

(57) ABSTRACT

A scissors lift includes a scissors arm assembly secured at one end to a base and coupled with a lift mechanism that expands and contracts the scissors arm assembly. A platform is supported at an opposite end of the scissors arm assembly via a plurality of load sensing pins that detect a vertical load on the platform. An interface module receives signals from the load sensing pins and communicates with the lift mechanism, wherein the interface module controls operation of lift functions and the lift mechanism according to the signals from the load sensing pins. Preferably, the load sensing pins are sized substantially the same as the conventional pins they replace. As a consequence, no redesign or additional structures are necessary to install the load sensing system and provide a safe operation of the scissors lift machine.

10 Claims, 7 Drawing Sheets

Scissor Lift in Fully Retracted Configuration.

Scissor Lift in Partially Elevated Configuration

Single Shear Load Sensing Pin

Double Shear Load Sensing Pin

Electronic Interface Module (EIM)

PLATFORM LOAD SENSING FOR VERTICAL LIFTS

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to industrial machinery and/or construction equipment such as vertical lifts including scissors lifts and, more particularly, to a measurement system that assesses a true load on a lift platform.

A vertical lift such as a scissors lift typically includes a lifting mechanism supporting a platform surrounded by safety rails or the like. The scissors lift is used for lifting, typically vertically, passengers and/or other heavy loads to desired heights. As a particularly heavy load is raised, the center of gravity of the lift machine can be raised to levels where the machine may be more susceptible to tilting or tipping. In this state, it would be desirable to deactivate certain critical functions of the machine that may increase the tipping hazard.

BRIEF SUMMARY OF THE INVENTION

The system of the present invention provides overload protection for vertical lifts such as scissors lifts. The system ensures that certain critical functions of the machine are deactivated in the event the platform is overloaded.

The platform is supported on four force sensing pins, which replace the standard structural pins presently used in the area where the platform connects to the upper arms of the scissors lifting mechanism. Both stationary types and sliding types of pins are replaced with the force sensing pins according to the invention. The sensing pins measure the vertical force placed upon them by all external loads and forces applied to the platform. An electronic interface module assesses the loading state of the machine by monitoring the sum of the four sensors. Alternatively, the load pins could be installed where the arms connect to the frame. By doing so, we are penalized with the weight of the scissors arm assembly. However, the varying center of gravity of the machine can be determined this way, and combined with the fixed center of gravity of the frame, stability of the scissors lift can be assessed in addition to measuring the platform load. Assessing stability would be possible since the tipping moment that can be generated by around slope (tilt) and/or by deflected scissor arms (for example when external force is pulling or pushing the platform) could be determined. In addition to the load penalty, another disadvantage is damage and abuse that could occur in this more exposed area.

One application of the system according to the invention is particularly configured to conform to an anticipated safety regulation in Europe (EN280 Document, Section 5.3.1.1). In this context, the system prevents any normal movement of the work platform from a stationary working position after the rated load is reached and before 120% of the rated load is exceeded. When normal movement is prevented in this manner, a warning consisting of a continuously flashing red light together with an acoustic signal is activated. The light continues to flash while the normal movement is prevented, and the acoustic alarm sounds for periods of at least five seconds repeated every minute. Movement can only restart if the overload is removed.

Of course, other applications of the system according to the present invention will be apparent to those of ordinary skill in the art, and the invention is not meant to be limited to the noted application that conforms to the anticipated safety regulation in Europe.

In an exemplary embodiment of the invention, a scissors lift includes a scissors arm assembly secured at one end to a base and coupled with a lift mechanism that expands and contracts the scissors arm assembly. A platform is supported at an opposite end of the scissors arm assembly via a plurality of load sensing pins that detect a vertical load on the platform. An interface module receives signals from the load sensing pins and communicates with the lift mechanism. The interface module controls operation of the lift functions and lift mechanism according to the signals from the load sensing pins.

The plurality of load sensing pins preferably includes fixed position pins, which accommodate relative rotary motion of the scissors arm assembly and the platform while detecting the vertical load on the platform, and sliding position pins, which accommodate lateral sliding motion between the scissors arm assembly and the platform and relative rotary motion of the scissors arm assembly and the platform while detecting the vertical load on the platform. Preferably the scissors lift includes four load sensing pins including two fixed position pins and two sliding position pins. Alternatively, the pins may include only sliding position pins. The pins are preferably sized corresponding to conventional structural pins.

The interface module determines the vertical load on the platform by summing the signals from the plurality of load sensing pins. In this context, the interface module is programmed to prevent movement of the platform via the scissors arm assembly when a rated load of the platform is exceeded. Additionally, the interface module may be further programmed to activate an alarm when the rated load of the platform is exceeded. A tilt sensor may be secured to one of the base or the platform that communicates with the interface module. The tilt sensor detects a tilt of the scissors lift, wherein the interface module adjusts the signals from the load sensing pins according to the tilt of the scissors lift. The interface module may additionally determine a center of gravity and/or a stability condition based on the load sensing pin signals.

In another exemplary embodiment of the invention, a scissors lift includes a scissors arm assembly including pivoting scissors arms secured at one end to a base. The scissors arm assembly is coupled with a lift mechanism that expands and contracts the scissors arm assembly by pivoting the scissors arms. A platform is supported at an opposite end of the scissors arms by a plurality of load sensing pins that detect a vertical load on the platform. The scissors arms rotate about the load sensing pins according to a position of the platform. An interface module receives signals from the load sensing pins and communicates with the lift mechanism. The interface module controls operation of the lift mechanism according to the signals from the load sensing pins.

In yet another exemplary embodiment of the invention, a method of operating the scissors lift includes the steps of (a) detecting a vertical load on the platform via the load sensing pins regardless of a position on the platform, and (b) controlling operation of the driving mechanism according to the detected vertical load. Step (b) may be practiced by preventing movement of the platform via the scissors arm assembly when a rated load of the platform is exceeded. Additionally, step (b) may be further practiced by activating an alarm when the rated load of the platform is exceeded. With the tilt sensor, the method further includes detecting a tilt of the scissors lift and adjusting the detected vertical load on the platform according to the tilt of the scissors lift. Step (a) may be practiced by summing signals from the plurality of load sensing pins.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
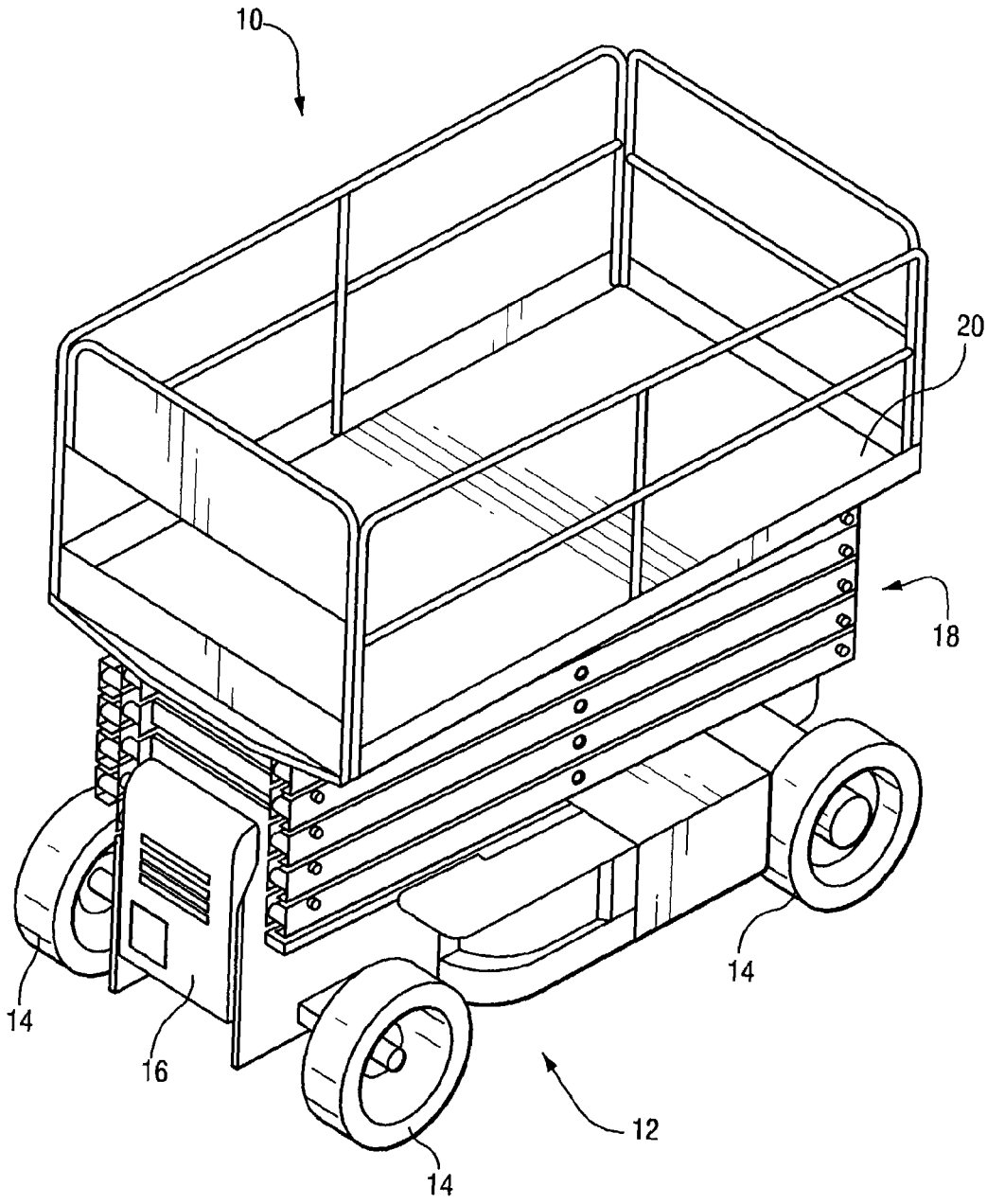
FIG. 1 is a perspective view of a scissors lift machine.

With reference to FIG. 1, a scissors lift 10 typically includes a frame or chassis 12 supported by a plurality of wheels 14. A drive mechanism 16 provides motive power for the wheels 14. A scissors arm assembly 18 is secured at one end to the frame 12 and at an opposite end to a platform 20. An internal lift mechanism expands and contracts the scissors arm assembly 18 to raise and lower the platform, respectively. The platform 20 is secured to the scissors arm assembly 18 via a plurality of load sensing pins 22, 24 (see FIGS. 2, 3) that detect a vertical load on the platform 20.

Figure 2:
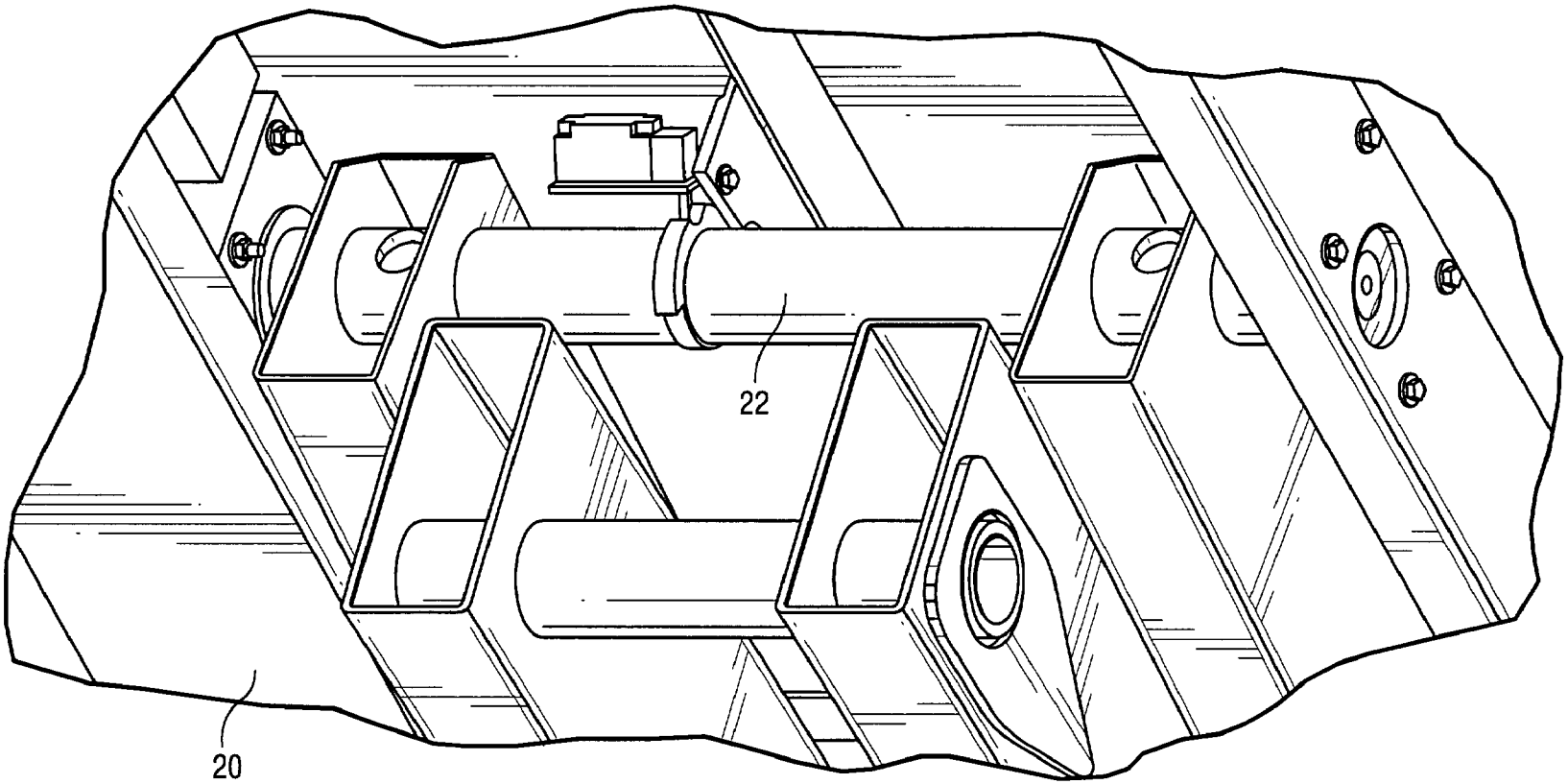
FIG. 2 shows a fixed position load sensing pin.
Figure 3:
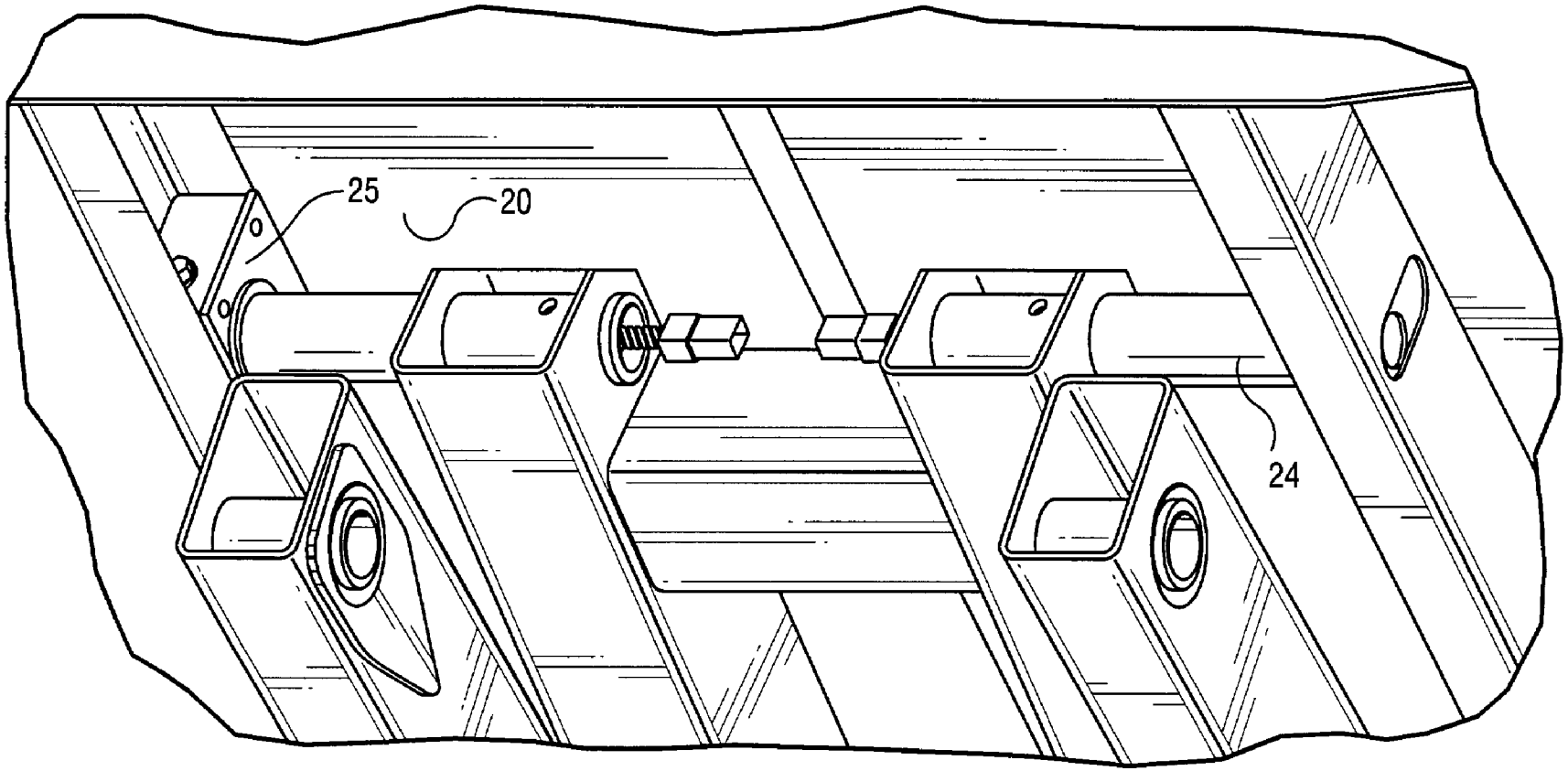
FIG. 3 shows a sliding position load sensing pin.

FIGS. 2 and 3 show an underside view of the platform 20, illustrating the fixed load sensing pins 22 (FIG. 2) and the sliding load sensing pins 24 (FIG. 3). As the scissors arm assembly 18 is expanded to raise the platform 20, the ends of the scissors arm assembly 18 are necessarily shifted toward each other. As a consequence, in a typical scissors lift assembly, there are four pins securing the platform 20 to the scissors arm assembly 18, two of which are fixed pins, and two of which are sliding pins. Conventional pins are replaced with the load sensing pins 22, 24 according to the invention. That is, the load sensing pins 22, 24 are constructed of a length and diameter substantially identical to the conventional pivot pins. The force sensing pins 22, 24 measure the vertical force placed upon them by all external loads and forces applied to the platform 20. A fixed load sensing pin 22 is shown in FIG. 2, and a sliding load sensing pin 24 is shown in FIG. 3. The sliding pins 24 accommodate rotary motion of the scissors arms 18 while maintaining the load on each pin in a vertical orientation. A certain weight on the platform 20 creates variable loads on the pins 22, 24 when the lift is raised or lowered. This is because the pins 22, 24 move relative to the platform 20 and reactions change accordingly. A total reading, however, should remain constant. The sliding pins 24 are installed in sliding blocks or bearings 25. The blocks have to be retained to prevent rotation, thus permitting the pins 24 to maintain a vertical orientation.

That is, both fixed 22 and sliding 24 load pins are constrained rotationally to the platform 20 so that the sensing axis is always vertical. Such mounting is mandated by the fact that the pins 22, 24 measure load in one particular direction, which in this application, preferably coincides with gravity direction (vertical). Such method of retaining the pins is not always the case for scissors with traditional structural pins. Indeed, some pins are secured to the arm assembly and therefore rotate about the platform. In such scissors, a redesign may be mandated.

Figure 4:
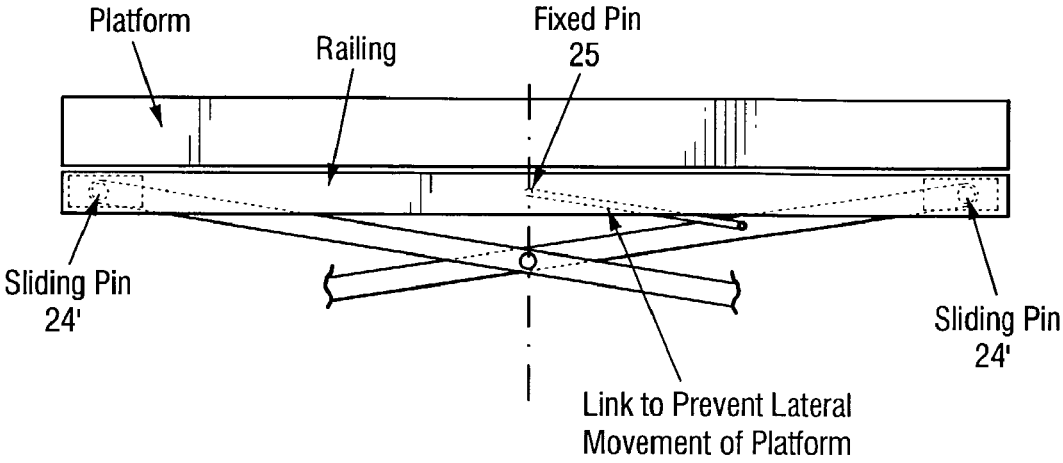
FIG. 4 shows a four sliding pin scissors lift in a fully retracted configuration.
Figure 5:
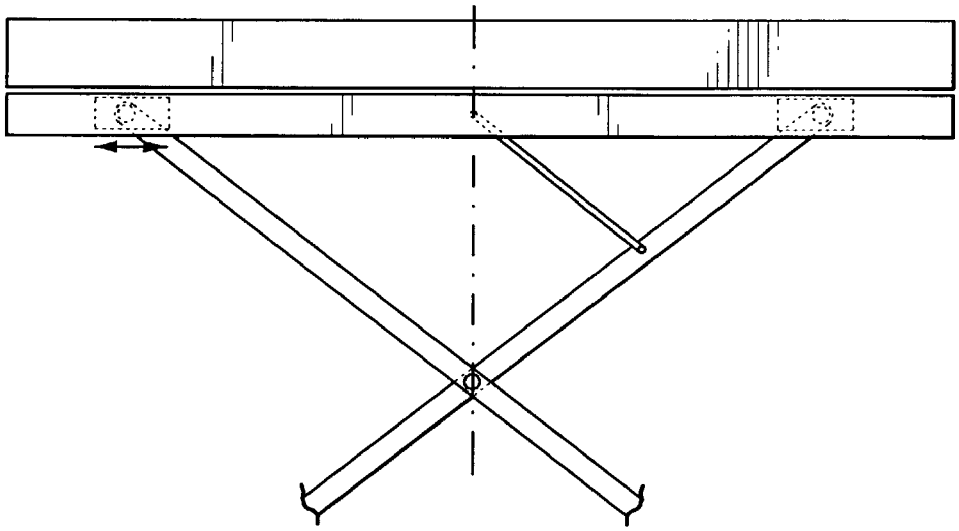
FIG. 5 shows the scissors lift of FIG. 4 in a partially elevated configuration.

In an alternative arrangement, with reference to FIGS. 4 and 5, all four pins 24' are of the sliding type. In this arrangement, two additional small pins 25 are added to the platform to prevent its lateral movement. These pins 25 carry minimal vertical load and therefore can be ignored. If more accuracy is required, the load on the pins 25 can be estimated via strain gauges for example (vertical and horizontal forces can be derived for the arms angle) or measured accurately via load pins. These pins 24' can either be single axis or dual axis, depending on the magnitude of the horizontal force. Alternatively, a single axis pin attached to the link in addition to measuring the arms angle is sufficient to predict the vertical force on them. FIG. 4 shows the alternative arrangement in a fully retracted configuration, and FIG. 5 shows the arrangement in a partially elevated configuration.

In still alternative arrangements, the system includes a combination of load sensing pins and traditional structural pins. The load on one or two pins may be constant, or may vary in accordance to some known relation, etc. Measuring the load at few pins may be enough to predict the load in the platform. Additional consideration can be made to the possibility of using less than four sensing pins, with the remaining pins being conventional structural pins.

As noted, the length and diameter of the load sensing pins are preferably kept identical to conventional pins. Indeed, for homogenization and cost savings, all load sensing pins will be of same length and same diameter (or two diameters) regardless of the scissor model. Traditionally, entire pins of a specific machine are of the same diameter. This includes pins in the arm assembly itself and at the connection of the arm assembly with the frame. This approach leads to substantially over-designed pins at the connection of the arm assembly with the platform (i.e., pins being monitored). These pins carry in general the smallest load. It was therefore judged for sake of cost savings (not to design several load sensing pins with different lengths and diameters) to redesign pins to adequately fit most if not all scissor models.

Figure 6:
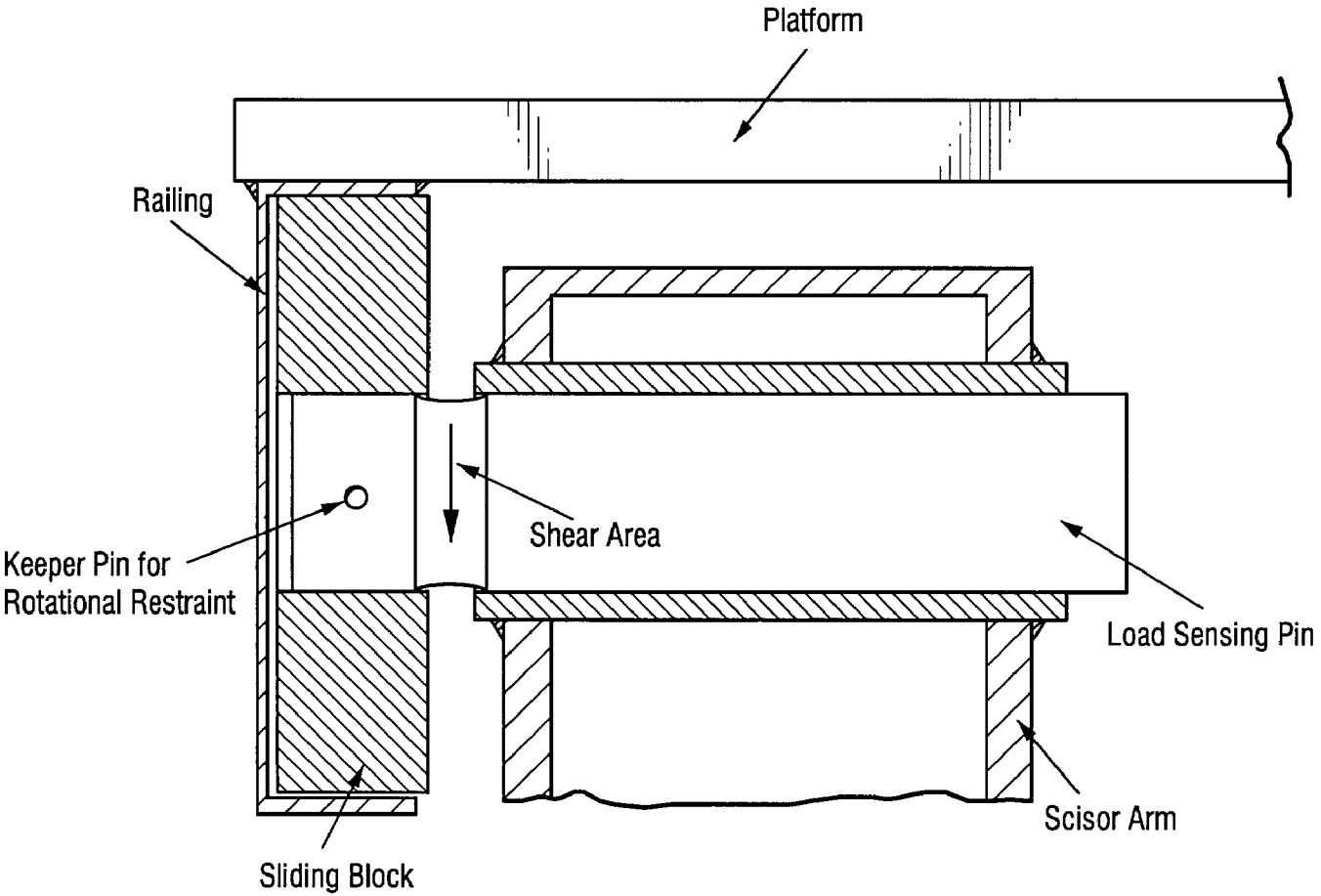
FIG. 6 is a schematic illustration of a single shear load sensing pin.
Figure 7:
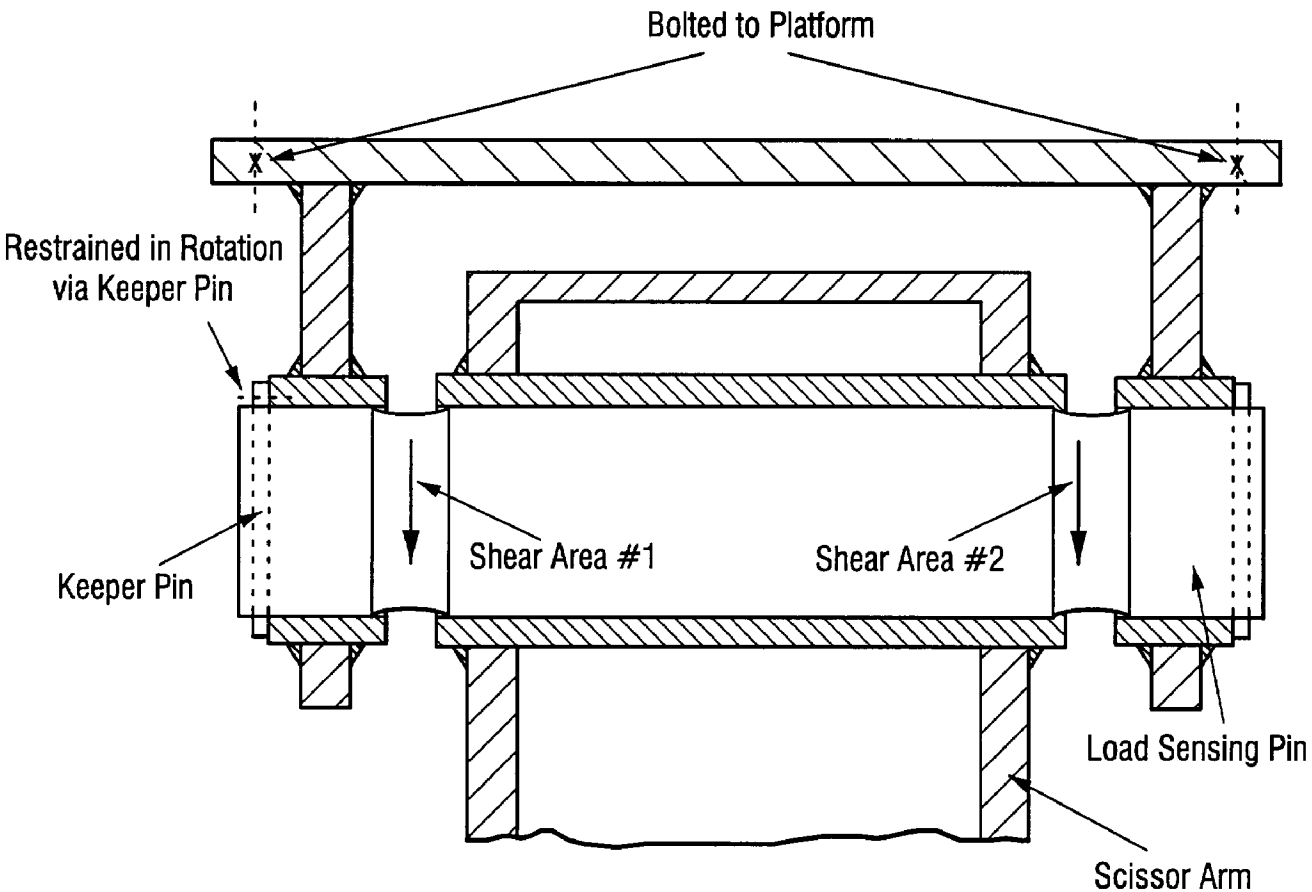
FIG. 7 is a schematic illustration of a double shear load sensing pin.

An explanation of how the pins perform their intended function can be given with reference to FIGS. 6 and 7. As a brief explanation, there is in the pin at least one shear area (reduced diameter area) where shear is predominant. By judiciously inserting strain gages in the shear zone, the magnitude of the applied force can be determined. Pins could have two shear areas, one on each end of the pin as shown in FIG. 7. The first type of pin shown in FIG. 6 is referred to as a "single shear pin," and the second type is referred to as a "double shear pin." Sliding pins 24 maintain the load in a vertical orientation because first the pins are secured rotationally to the sliding block 25 so that the sensing axis is always vertical, and second the maximum generated horizontal force is equal to the friction between the slide blocks and the rails. Obviously this friction force is kept to a strict minimum by design, and therefore the loading on the sliding pins is substantially vertical. Due to equilibrium, the horizontal force on the fixed pins is equal and opposite to the friction force on the sliding pins. Using the same argument, the load on the fixed pins is also substantially vertical.

Figure 8:
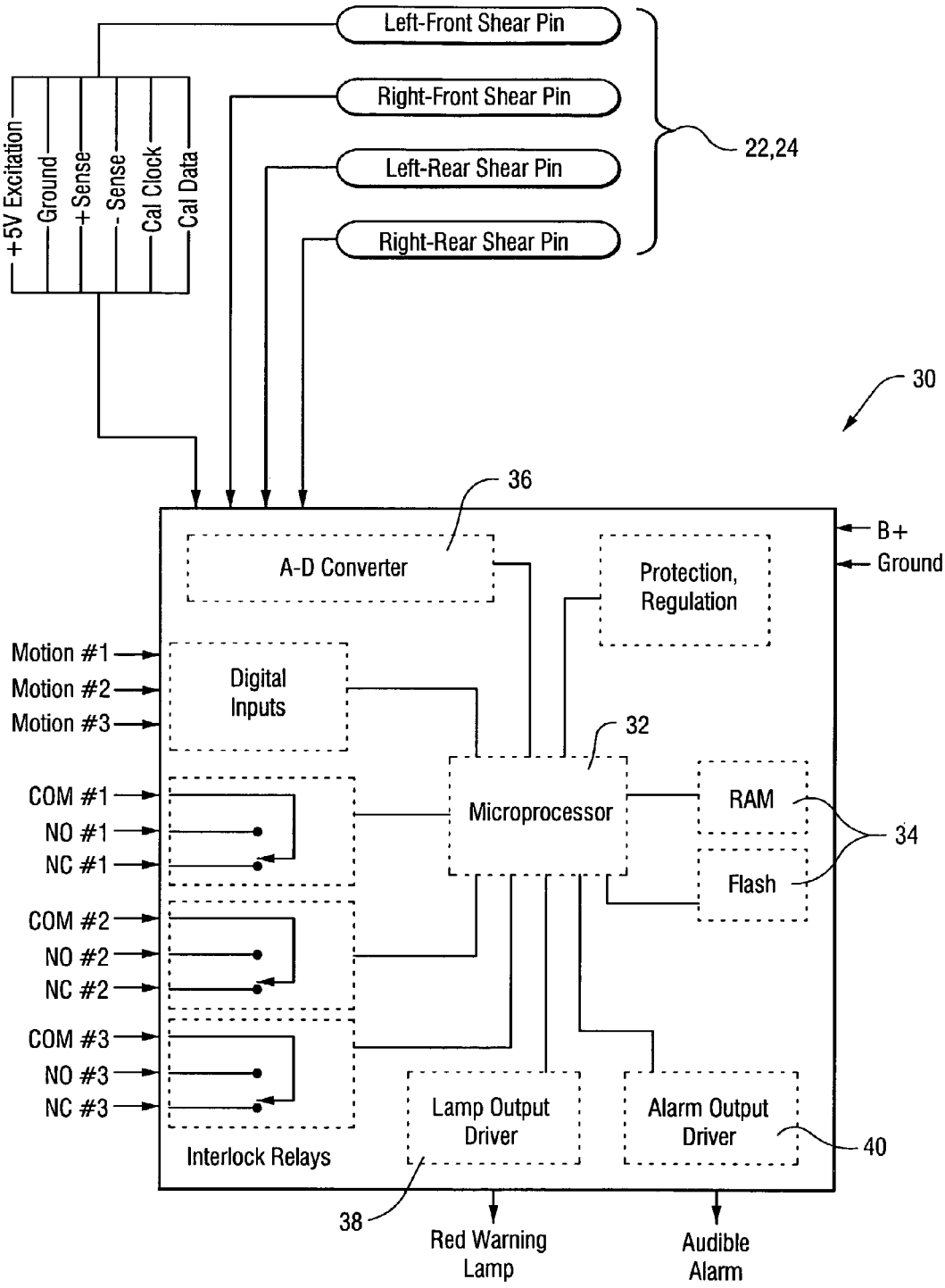
FIG. 8 is a schematic circuit diagram of an interface module.

With reference to FIG. 8, the load sensing pins 22, 24 communicate with an electronic interface module 30 that assesses the loading state of the machine by monitoring the sum of the four sensors 22, 24. The electronic interface module 30 communicates with the lift mechanism and controls operation of the lift mechanism according to the signals from the load sensing pins 22, 24. The electronic interface module 30 includes a microprocessor 32 that carries out a control program stored in the system memory 34. An A/D converter 36 converts the signals from the load sensing pins 22, 24 for processing by the microprocessor 32. A tilt sensor 37 may be secured to one of the frame 12 or the platform 20 and communicates with the microprocessor 32. The tilt sensor 37 detects a tilt of the scissors lift machine, and the microprocessor 32 adjusts the signals from the load sensing pins 22, 24 according to the detected out of level angle. The tilt sensor 37 is generally provided to assess the inclination or tilt of the machine. By regulation, if the tilt is higher than a certain predetermined angle (typically 2 to 5 deg.) all functions should be cut. This tilt or angle sensor 37 can be used to correct the load pin readings. Another possibility is to attach the angle sensor 37 to the platform 20 in order to assess the true tilt of the platform (which includes arms sway) and correct the load readings accordingly.

Another angle sensor (not shown) may be used to detect arms angle and consequently platform elevation. Information from this angle sensor can be used to calculate center of gravity of the loaded platform and control overload of a deck extension. Alternatively, a direct measure (via cable reel for example) of the distance between the fixed and sliding pins may be sufficient.

Relays may be provided to permit control of the different type of machines with the same electronic interface module. Some machines are microprocessor based and others are electro-mechanical, which could either be electric or engine powered.

In operation, the interface module 30 controls operation of the driving mechanism and lift vehicle functions according to signals from the load sensing pins 22, 24. In one application, the system can be conformed to an anticipated new safety regulation in Europe. In this context, the interface module 30 prevents any normal movement of the work platform 20 from a stationary working position after a rated load is reached and before, e.g., 120% of the rated load is exceeded. When normal movement is prevented in this manner, a warning consisting of a continuously flashing red light via the lamp output driver and red warning lamp 38 together with an acoustic signal via the alarm output driver and audible alarm 40 is activated by the microprocessor 32. The light continues to flash as long as normal movement is prevented according to the detected platform load, and the acoustic alarm is programmed to sound for periods of at least five seconds repeated every minute. Movement can only restart if the platform overload is removed. Of course, the system can be programmed to effect operation according to numerous parameters, and the invention is not necessarily meant to be limited to the described exemplary application.

The interface module 30 additionally provides for dynamic load monitoring, which exceeds the static monitoring requirements of known regulations including the noted anticipated safety regulation in Europe. That is, with an arrangement dedicated to static monitoring requirements, the system typically allows the load to settle once the lift is stationary prior to recalculating the load condition. In contrast, the interface module 30 of the present invention has the ability (in addition to static measurements) to provide constant "dynamic" monitoring, thereby preventing the possibility of overloading the platform while the platform is in motion. Moreover, provisions can be embedded into the operation of the interface module 30 to monitor and/or prevent the occurrence of crushing, either in the platform or underneath the platform. In this context, the interface module can be programmed to detect load increases or decreases over time such that if the platform encounters an obstruction as the platform is being raised, the system can detect a sudden increase in load over a short period of time and immediately shut down and/or back off the raising platform. On the other hand, if the platform encounters an obstruction as it is being lowered, the interface module 30 would detect a sudden decrease in load via the load sensing pins 22, 24 and immediately stop the platform.

Still further, the interface module 30 can flag events that may affect the accuracy of the load sensing pins 22, 24. For example, if the load exceeds some predetermined pin yield force, the load sensing pins 22, 24 may be displaced into a false reading. If such a load is detected, the system can alert the operator to inspect the load sensing pins.

Moreover, as still another advantageous feature of the interface module 30 of the present invention, as the platform is raised, the sliding pins 24 necessarily change their position relative to the platform load. As a consequence, with platform elevation monitoring, readings from the load sensing pins 22, 24 can be processed to determine a center of gravity of the load. In this manner, a stability condition can be determined. This functionality can be particularly advantageous if a deck extension (including dual deck extension arrangements) is used with the lifting platform.

With the system of the present invention, since the size and diameter of the sensing pins can be kept identical to the conventional pins they replace, assembly is easy and design changes are kept to a strict minimum. The system does not incorporate additional parts to measure the load, as is the case with load cells and the like, but rather merely adapts existing parts to perform additional functions.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A scissors lift comprising:

a scissors arm assembly secured at one end to a base and coupled with a lift mechanism that expands and contracts the scissors arm assembly;

a platform supported at an opposite end of the scissors arm assembly via a plurality of load sensing pins that detect a vertical load on the platform, wherein the load sensing pins replace conventional structural pins between the platform and the opposite end of the scissors arm assembly;

an interface module receiving signals from the load sensing pins and communicating with the lift mechanism, the interface module controlling operation of lift functions and the lift mechanism according to the signals from the load sensing pins, wherein the interface module determines a center of gravity of the vertical load on the platform based on the signals from the load sensing pins and platform height or elevation information acquired by direct or non-direct measurement; and a tilt sensor secured to one of the base or the platform that communicates with the interface module, the tilt sensor detecting tilt of the scissors lift, wherein the interface module adjusts the signals from the load sensing pins according to the tilt of the scissors lift.

2. A scissors lift according to claim 1, wherein the plurality of load sensing pins comprise fixed position pins, which accommodate relative rotary motion of the scissors arm assembly and the platform while detecting the vertical load on the platform, and sliding position pins, which accommodate lateral sliding motion between the scissors arm assembly and the platform and relative rotary motion of the scissors arm assembly and the platform while detecting the vertical load on the platform.

3. A scissors lift according to claim 2, comprising four load sensing pins including two fixed position pins and two sliding position pins.

4. A scissors lift according to claim 1, wherein the plurality of load sensing pins comprise sliding position pins, which accommodate lateral sliding motion between the scissors arm assembly and the platform and relative rotary motion of the scissors arm assembly and the platform while detecting the vertical load on the platform.

5. A scissors lift according to claim 4, comprising four load sensing pins including four sliding position pins.

6. A scissors lift according to claim 1, wherein the plurality of load sensing pins are sized corresponding to conventional structural pins.

7. A scissors lift according to claim 1, wherein the interface module determines the vertical load on the platform by summing the signals from the plurality of load sensing pins.

8. A scissors lift according to claim 7, wherein the interface module is programmed to prevent movement of the platform via the scissors arm assembly when a rated load of the platform is exceeded.

9. A scissors lift according to claim 8, wherein the interface module is further programmed to activate an alarm when the rated load of the platform is exceeded.

10. A scissors lift according to claim 1, wherein the interface module detects a stability condition based on the center of gravity of the vertical load on the platform.

* * * * *